United States Patent [19]

Wiand

[11] 4,131,436

[45] Dec. 26, 1978

[54] OPHTHALMIC FLAT ROUGHING WHEEL

[76] Inventor: Ronald C. Wiand, 1790 Washington, Birmingham, Mich. 48009

[21] Appl. No.: 832,362

[22] Filed: Sep. 12, 1977

[51] Int. Cl.[2] ..... B24D 5/14; B24D 7/14

[52] U.S. Cl. ..... 51/309 R; 51/295; 51/297

[58] Field of Search ..... 51/293, 297, 298, 307, 51/308, 309, 295

[56] References Cited

U.S. PATENT DOCUMENTS

| | | | |
|---|---|---|---|
| 1,826,300 | 10/1931 | Chapell | 51/298 |
| 2,479,078 | 8/1949 | Milligan et al. | 51/308 |
| 2,766,565 | 10/1956 | Robinson et al. | 51/309 |
| 3,203,774 | 8/1965 | Pratt | 51/309 |
| 3,298,806 | 1/1967 | Cicchelli | 51/293 |
| 3,785,938 | 1/1974 | Sam | 51/309 |

*Primary Examiner*—Donald J. Arnold

*Attorney, Agent, or Firm*—Harness, Dickey & Pierce

[57] ABSTRACT

An ophthalmic flat roughing wheel having a circumferential grinding layer made of a diamond-containing metallic matrix having greater diamond concentration in the center than at the edges. The wheel is made by bonding to the circumferential surface of a wheel blank, a diamond-containing metallic matrix of relatively high diamond concentration sandwiched between diamond-containing metallic matrixes of relatively lower diamond concentrations.

11 Claims, 5 Drawing Figures

FIG. 1.
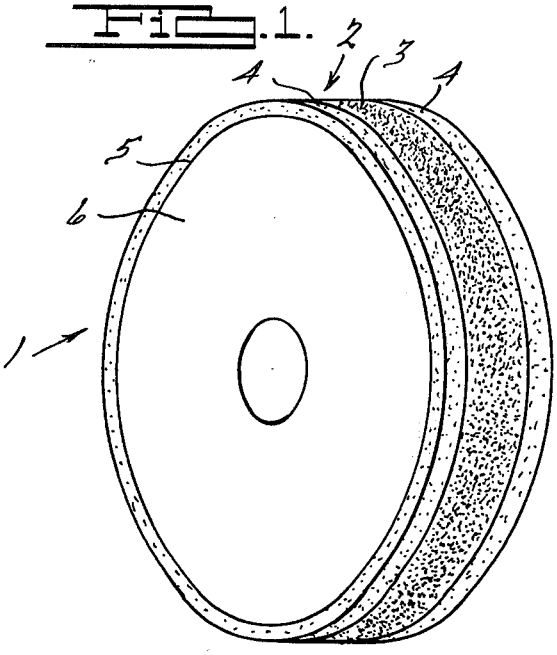
FIG. 2.
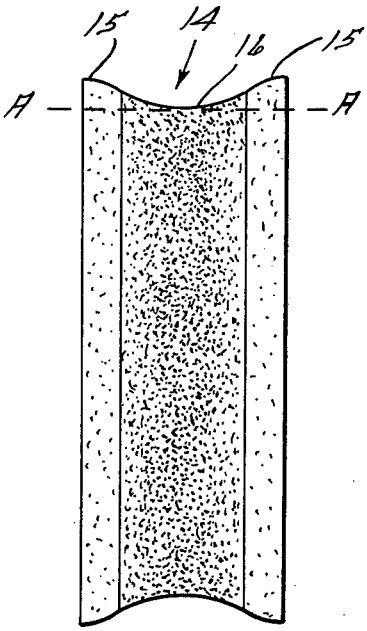
FIG. 3.
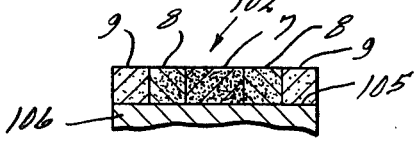
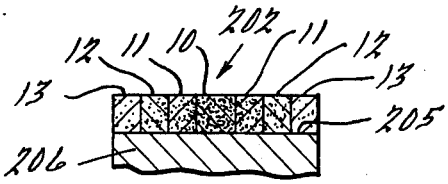
FIG. 4.
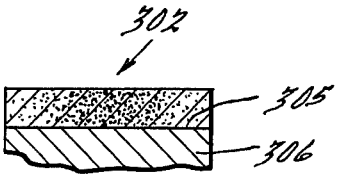
FIG. 5.

OPHTHALMIC FLAT ROUGHING WHEEL

BACKGROUND OF THE INVENTION

The present invention relates to ophthalmic flat roughing wheels which are used to grind the edges of glass and plastic lenses and a method of making a wheel of the present invention.

It is common practice in the optical industry to mold or fabricate plastic or glass lenses to oversized dimensions and then grind the edges of the lenses to a particular shape and size to properly fit a particular frame. The lenses are first rough ground with a flat roughing wheel and then fine ground and beveled with a beveling or finishing wheel. A beveled edge is generally required to secure the lens to the frame. A conventional flat roughing wheel has a grinding surface layer which is made of uniformly distributed diamond particles in a metallic matrix and which is wide enough to accommodate lenses of various widths and diopters as is encountered in commercial use. The use of a conventional flat roughing wheel to grind lenses of various widths and diopters results in a "hollowed out" area in the center of the grinding surface where most wear is experienced. For continued use, such a wheel must be "re-trued" to present a flat grinding surface by grinding down the high edges of the grinding layer. It would be desirable, however, if a roughing wheel could be made which would remain flat for a longer period of use and which would be easier to re-true. And in accordance with the present invention, it has been discovered that this can be uniquely accomplished.

Heretofore it has been known to make abrasive wheels for various uses having sections of varying degrees of wear resistance and composition although it has remained for the present inventor to discover the particular ophthalmic flat roughing wheel of the present invention as well as a method of making the wheel and its use. Examples of patents teaching abrasive disks having layered or varying make-up include U.S. Pat. No. 3,203,774, Aug. 31, 1965 to Pratt for "Method of Making an Abrasive Cut-Off Disk"; U.S. Pat. No. 1,986,849, Jan. 8, 1935 to Pohl et al. for "Abrading Material and Process for Preparing the Same"; U.S. Pat. No. 2,084,513, June 22, 1937 to Tone for "Abrasive Article"; U.S. Pat. No. 2,027,132, Jan. 7, 1936 to Webster for "Grinding Wheel"; U.S. Pat. No. 1,403,416, Jan. 10, 1922 to Katzenstein for "Abrasive Wheel for Form Grinding"; U.S. Pat. No. 226,066, Mar. 30, 1880 to Hart for "Emery Wheel"; U.S. Pat. No. 440,682, Nov. 18, 1890 to Wood for "Burr Remover"; U.S. Pat. No. 3,049,843, Aug. 21, 1962 to Christiansen for "Abrasive Cutting Devices"; U.S. Pat. No. 2,600,815, June 17, 1952 to Turner for "Apparatus for Rough and Fine Grinding of Spherical Surfaces"; and U.S. Pat. No. 1,399,400, Dec. 6, 1921 to Pellow for "Lens Grinder".

Wherefore, it is an object of this invention to provide a new and improved ophthalmic grinding or roughing wheel and a new method of making same. It is a further object of this invention to provide an ophthalmic roughing wheel which can be used longer than a conventional wheel but is economical to manufacture. Yet another object of the present invention is to provide a new type of roughing wheel which is easier and more economical to "re-true" than conventional wheels.

SUMMARY OF THE INVENTION

The present invention relates to an ophthalmic flat roughing wheel particularly adapted for long use in grinding the edges of glass or plastic lenses. The wheel of this invention has a circumferential grinding layer made of a diamond-containing metallic matrix having a relatively greater concentration of diamond in the center than toward the edges. This provides a wheel which tends to remain flat or true longer during use and which can be re-trued easier than conventional wheels.

An abrasive wheel of the present invention is made by bonding to the circumferential surface of a wheel blank, a diamond-containing metallic matrix of relatively high diamond concentration sandwiched between diamond-containing metallic matrixes of relatively low diamond concentrations thereby forming a circumferential grinding layer having a greater concentration of diamond at the center than toward the edges. The circumferential grinding layer can comprise three, five, seven, nine or a multiplicity of metallic matrixes having different diamond concentrations increasing from the edge to the center.

BRIEF DESCRIPTION OF THE DRAWING

FIG. 1 is a perspective view of a roughing wheel of the present invention.

FIG. 2 is an elevation taken perpendicular to the axis of a roughing wheel of the present invention showing a "hollowed-out" wear pattern.

FIG. 3 is a cross section, broken away, through the grinding layer of a modified form of the present invention.

FIG. 4 is a cross section, broken away, through the grinding layer of another modified form of the present invention.

FIG. 5 is a cross section, broken away, through the grinding layer of yet another modified form of the present invention.

DESCRIPTION OF THE INVENTION

The present invention relates to an ophthalmic flat roughing wheel having a long useful life when used for grinding the edges of glass or plastic lenses as is commonly done in the optical industry to shape lenses to fit a particular frame. The roughing wheel of the present invention contains diamond dust or diamond fragments embedded in a metallic matrix about the circumference of a metal wheel as does a conventional roughing wheel. However, the circumferential or grinding layer of a conventional wheel is made of a metallic matrix with diamond particles uniformly distributed therein resulting in greater wear in the center than along the edges during commercial use because the edges of the grinding surface contact fewer lenses than does the center. While the useful life of a conventional roughing wheel could be extended by oscillating its point of contact with lenses to distribute its use more evenly, the present invention provides a more practical and less complex means by which the useful life of such wheels can be extended.

Furthermore, when after extended use, the grinding layer of a wheel of the present invention develops a hollowed-out wear pattern, it can be re-trued to a flat surface with a minimum waste of diamond material. In addition, the abrasive wheel of this invention is easier to re-true because it contains fewer diamond particles at the edges which must be ground away. Still further, the advantages of this invention can be achieved without increasing the quantity of diamond material contained in a roughing wheel. This is, of course, important because of the expensive nature of diamond material.

Briefly, the present invention is described as follows. With reference to FIG. 1, an abrasive wheel 1 of the present invention has a circumferential grinding layer generally indicated by numeral 2, made of a thickness of a diamond-containing metallic matrix. In accordance with one embodiment of the present invention the center section 3 contains a greater concentration of diamond particles than edge sections 4 of grinding layer 2. The circumferential grinding layer 2 comprising center section 3 and edge sections 4 is bonded to the circumference 5 of core 6 which is a metal wheel referred to herein and in the art as a blank.

FIGS. 3, 4, and 5 show additional embodiments of the present invention. As shown in FIG. 3, a circumferential grinding layer 102 is bonded to the circumference 105 of wheel 106 and has five sections of metallic matrix, a center section 7 having relatively high concentration of diamond particles, intermediate sections 8 having a relatively lower concentration of diamond particles, and edge sections 9 having a still lower concentration of diamond particles. Similarly, FIG. 4 shows another embodiment of the present invention in which circumferential grinding layer 202 bonded to circumference 205 of wheel 206 has seven sections of metallic matrix, a center section 10 having the greatest diamond concentration and sections 11, 12, and 13 having respectively lower diamond concentrations. As illustrated in FIGS. 3 and 4, the line between sections of diamond-containing metallic matrix may not be exact and well-defined. In fact, if the grinding layer is made by the method disclosed herein of sandwiching, pressing, and sintering metallic matrix powders containing diamond particles in different concentrations, there will be a substantial amount of fusion between sections and no precise line of demarcation therebetween. This is thought, however, to be advantageous in the present invention and is preferred.

FIG. 5 shows another embodiment of this invention wherein circumferential grinding layer 302 bonded to the circumference 305 of wheel 306 has a diamond-containing metallic matrix characterized by a gradient diamond concentration with the greatest diamond concentration at the center and the lowest diamond concentration at the edges.

With the exception of the concentration of diamond material contained therein, it is contemplated that the grinding layer comprising the diamond-containing metallic matrix will be made of generally uniform materials in a roughing wheel of the present invention. Of course, some variation in materials can be tolerated within the grinding layer so long as the variation is made without losing the advantages of the present invention. Suitable diamond particles for use in the metallic matrix will be apparent to those skilled in the art and include diamond dust or diamond chips derived from either natural or synthetic sources. Suitable metallic matrixes will also be apparent and are those well known in the art for use in metal-bonded diamond wheels, for example, metallic matrixes made of iron, copper, tin, cobalt, silver, bronze, and brass and mixtures thereof.

A roughing wheel of the present invention as shown in FIG. 1 can be made by the following process. Two mixtures of diamond material and matrix metal powder are made by mixing diamond dust or chips and powdered metal. The second mixture is made so that it contains a relatively greater concentration of diamond material than does the first mixture. It is preferred that the second mixture contain diamond material at a weight concentration, (e.g. carats per gram of total mixture) from 1½ to 10 times that of the first mixture. Suitable diamond content for the first mixture can vary from about 0.10 carats per gram of total mixture to about 0.25 carats per gram of total mixture. Suitable diamond content for the second mixture can vary from about 0.26 carats per gram of total mixture to about 1.00 carats per gram of total mixture.

The quantity of first and second mixtures used to make a roughing wheel of this invention depends upon the relative widths and thicknesses of the center section 1 corresponding to the second mixture of relatively high concentration of diamond material and the side sections 2 and 3 of relatively low concentrations of diamond material. The exact proportions of center and side sections are not critical to obtain at least some of the benefits of the present invention. However, it has been found preferable that the center section be about 2 to 4 times as wide as the side sections which are substantially equal in width. Most preferably, the center section is three times as wide as each side section. Of course, generally the center and side sections will be of equal thickness, although the exact thickness is not critical.

The first and second mixtures are next bonded to the circumferential surface of the blank wheel. This step is preferably accomplished by layering the second mixture between two first mixtures in sandwich fashion in a suitable mold and then pressing and sintering the mixtures by the well-known methods to effect a bond between the diamond-containing metallic matrix metals and the blank. It is contemplated that sintering will cause a fusing of the mixtures resulting in blending, to some extent, of one section into another. This effect is advantageous in the present invention because it is believed to maximize the benefits obtained from the present invention. However, it is within the scope of the present invention to press and sinter each section or mixture separately thereby minimizing the fusion between layers.

The resulting roughing wheel will have a greater amount of diamond particles in the center section of the wheel where the most use is experienced by the wheel. Yet there is a sufficient amount of diamond particles in the edge sections of the wheel to provide for grinding of relatively wide or thick lenses. Because of the lesser concentration of diamond in the side sections, they tend to wear more easily than the center section and thus tend to avoid the "hollowed-out" wear pattern which results when such wheels are put into commercial use where most grinding is carried out by the center section. This "re-trueing" feature of the present invention and the extent to which the useful life of roughing wheels can be extended by use of the present invention, without the use of any additional diamond material, was surprising and unexpected.

Of course, although greatly increased wearability is obtained by the present invention, the roughing wheel eventually wears and presents a "hollowed-out" surface as shown in FIG. 2 as area 14. As is evident from the FIG. 2, when the wheel's surface is ground to present a true surface along the plane A—A, the material which must be ground is that of the edge sections 15, that is, metallic matrix of relatively lower diamond content. The grinding of zones 15 is of course, facilitated by their lower diamond content and waste of diamond material is minimized.

While the above method has been set forth in terms of three sections of diamond containing matrix metal mixtures, the method can be practiced by using five, or seven, or any multiplicity of mixtures so long as they are bonded to the blank wheel so that the diamond concentration increases toward the center section mixture.

While the foregoing disclosure has been set forth to describe the present invention, it will be apparent to those skilled in the art that minor variations may be made without departing from the spirit of the present invention and such variations are intended to be included within the scope of the following claims. The following examples are offered to further illustrate the invention.

EXAMPLE I

Four carats of synthetic diamond dust and 84 grams of a mixture of 80% iron and 20% bronze metal powder are mixed to form a first mixture. Sixteen carats of synthetic diamond dust and 121 grams of a mixture of 80% iron and 20% bronze metal powder are mixed to form a second mixture. One half of the first mixture is layered into a round metal mold having a 6" inside diameter and an inner core having a 5-13/16" outer diameter. Next, all of the second mixture is layered in the mold on top of the first mixture and then the remaining half of the first mixture is layered on top of the second mixture. The layered mixtures are cold pressed with about 85 tons and then the inner core is removed and replaced with a metal blank of the same dimensions. The mold, metal blank and metal matrix mixtures are heated at about 1600° F for about 1½ hours and then hot pressed at temperatures with 30 tons. After the mold has cooled, the blank which now has bonded to it the diamond-containing metallic matrix is removed and excess metal on the sides is removed to yield a roughing wheel about ⅝ inches wide having two edge sections of relatively lower diamond concentration ⅛ inches in width and a center section having relatively higher diamond concentration ⅜ inches in width. The wheel has a six inch outer diameter and a 3/32 inch thick diamond-containing grinding layer.

A roughing wheel made in accordance with the present example has about twice the useful life of a conventional roughing wheel having the same dimensions and diamond content, but with uniform diamond concentration in its grinding layer.

EXAMPLE II

An ophthalmic flat roughing wheel is made as in Example I except that a third mixture of synthetic diamond dust and metal powder is layered in the mold intermediate each layer of first and second mixtures. The third mixture contains six carats of synthetic diamond dust and 84 grams of 80% iron, 20% bronze metal powder. The resulting roughing wheel is about ⅞" wide and has a section of intermediate diamond concentration between each edge section and the center section.

EXAMPLE III

An ophthalmic flat roughing wheel is made as in Example II except that a fourth mixture of synthetic diamond dust and metal powder is layered in the mold intermediate each layer of second and third mixtures. The fourth mixture contains eight carats of synthetic diamond dust and 84 grams of 80% iron, 20% bronze metal powder. The resulting roughing wheel is about 1⅛" wide and presents a grinding surface of seven sections having increasing diamond concentration toward the center section.

What is claimed is:

1. An ophthalmic flat roughing wheel having a circumferential layer made of a diamond-containing metallic matrix having a relatively greater concentration of diamond in the center than at the edges.

2. A wheel as recited in claim 1 wherein said diamond-containing metallic matrix has a diamond concentration of from about 0.10 to about 0.25 carats per gram at the edges and from about 0.26 to about 1.00 carats per gram at the center.

3. A wheel as recited in claim 1 wherein said diamond-containing metallic matrix has a diamond concentration at the center which is from 1½ to 10 times greater than the diamond concentration at the edges.

4. An ophthalmic flat roughing wheel having a circumferential layer made of a diamond-containing metallic matrix comprising a center section and two edge sections, said center section having a greater diamond concentration than said edge sections.

5. A wheel as recited in claim 4 wherein said diamond-containing metallic matrix comprises two intermediate sections between said center section and each of said edge sections, said intermediate sections having a diamond concentration less than said center section but greater than said edge sections.

6. A wheel as recited in claim 5 wherein said diamond-containing metallic matrix comprises two additional sections between said center section and each intermediate section, said additional sections having a diamond concentration less than said center section but greater than said intermediate sections.

7. A wheel as recited in claim 4 wherein said diamond-containing metallic matrix comprises a multiplicity of sections between said center section and said edge sections, said multiplicity of sections being characterized by increasing diamond concentration towards said center section.

8. A process for making an ophthalmic flat roughing wheel comprising the steps of:

(A) providing two first diamond-containing powdered metallic matrix mixtures having substantially equal diamond concentration;

(B) providing a second diamond-containing powdered metallic matrix mixture having a relatively greater concentration of diamond particles than said first mixtures;

(C) bonding a layer of said first and second mixtures to a blank wheel, said second mixture sandwiched between each of said first mixtures on the circumferential surface of said wheel.

9. The process of claim 8 wherein two third diamond-containing powdered metallic matrix mixtures are sandwiched between said second mixture and each of said first mixtures in step (C), said third mixtures having a diamond concentration greater than said first mixture but less than said second mixtures.

10. The process of claim 9 wherein two fourth diamond-containing powdered matrix metal mixtures are sandwiched between said second mixture and each of said third mixtures in step (C), said fourth mixtures having a diamond concentration greater than said third mixtures but less than said second mixture.

11. The process of claim 8 wherein step (C) is carried out by sintering.

* * * * *